United States Patent [19]

Kimmell et al.

[11] 4,138,127

[45] Feb. 6, 1979

[54] TWO WHEEL ROLLER SKATE OR THE LIKE

[75] Inventors: Steven D. Kimmell, Granada Hills; Benjamin H. Stansbury, Jr., Beverly Hills, both of Calif.

[73] Assignee: Mattel, Inc., Hawthorne, Calif.

[21] Appl. No.: 849,549

[22] Filed: Nov. 8, 1977

[51] Int. Cl.[2] ..... A63C 17/02

[52] U.S. Cl. ..... 280/11.23; 280/11.28

[58] Field of Search ..... 280/11.22, 11.23, 11.27, 280/11.28, 87.04 R, 87.04 A, 7.13, 11.19

[56] References Cited

U.S. PATENT DOCUMENTS

| | | | |
|---|---|---|---|
| 2,509,324 | 5/1950 | Van Horn | 280/11.28 |
| 2,632,652 | 3/1953 | Wintercorn | 280/11.28 |
| 3,331,612 | 7/1967 | Tietge | 280/11.28 |
| 3,649,038 | 3/1972 | Huckenbeck | 280/11.28 |

FOREIGN PATENT DOCUMENTS

| | | | |
|---|---|---|---|
| 10764 of | 1911 | United Kingdom | 280/11.28 |

*Primary Examiner*—Joseph F. Peters, Jr.
*Assistant Examiner*—Gene A. Church
*Attorney, Agent, or Firm*—John C. Mesaros; Max E. Shirk; Ronald M. Goldman

[57] ABSTRACT

A two wheel roller skate or the like having two wheels rotatably supported from a soleplate, one at the front and one at the rear thereof, the axes of rotation of the two wheels being normally parallel to each other. Each of the wheels is supported within a cradle for rotation about an axis extending generally in the direction of the longitudinal center line of the soleplate and at an angle thereto, the axis of pivoting of the cradle member being a steering axis disposed below the axis of rotation of the wheel member.

11 Claims, 6 Drawing Figures

FIG. 1
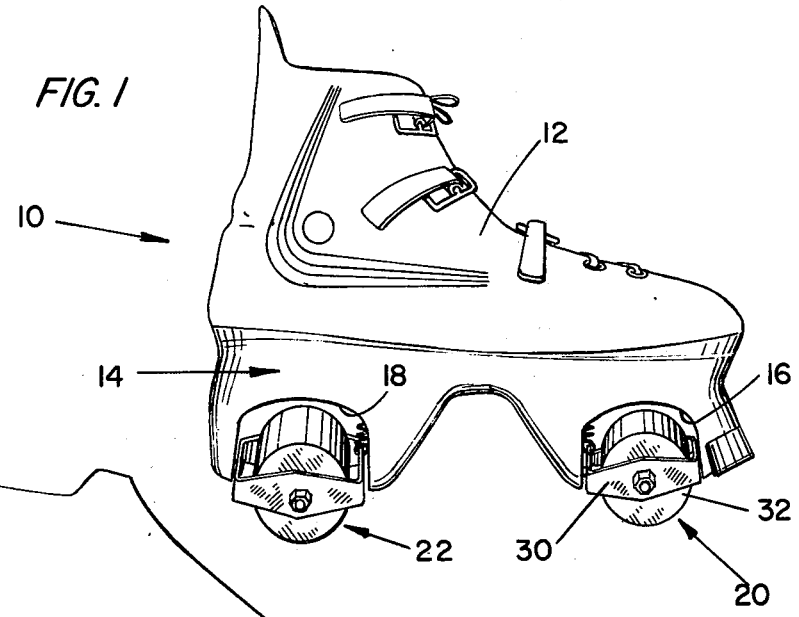
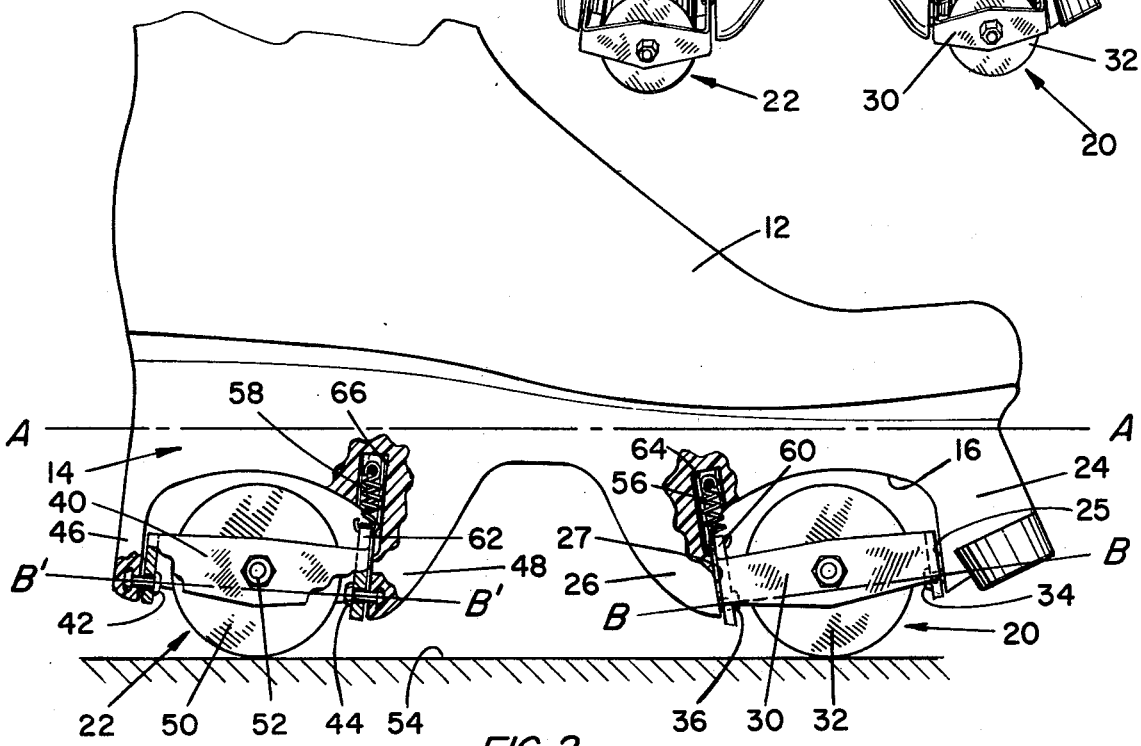
FIG. 2
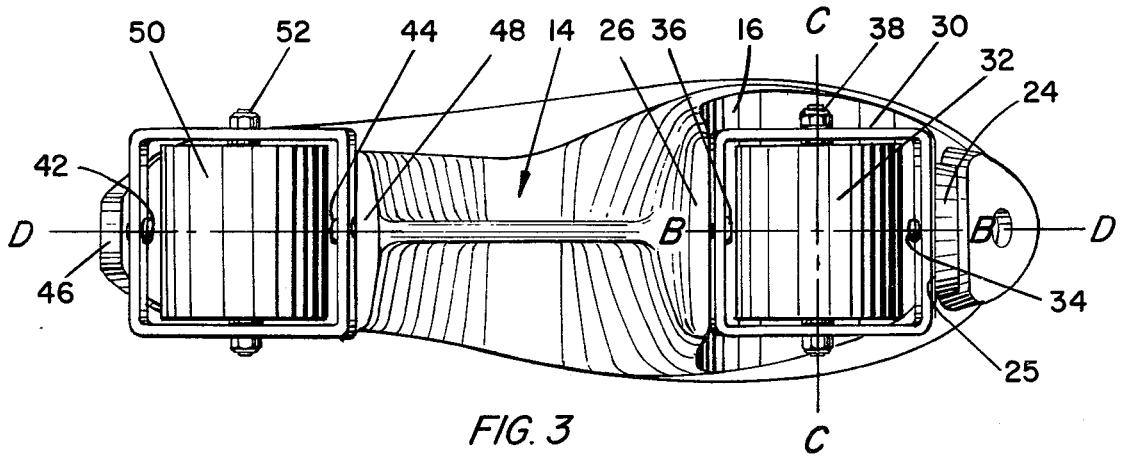
FIG. 3

TWO WHEEL ROLLER SKATE OR THE LIKE

BACKGROUND OF THE INVENTION

The background of the invention will be discussed in two parts:

1. Field of the Invention

This invention relates to roller skates or skateboards or the like, and more particularly to such devices having two wheels.

2. Description of the Prior Art

In roller skates or skateboards, there is a rider supporting member such as a soleplate in the case of a roller skate or a board in the case of a skateboard, which rider supporting member has in depending relation therewith, a pair of trucks, each of the trucks having rotatably coupled thereto a pair of wheels, with the truck being designed and configured for causing the two axles, which are normally parallel to each other, to simultaneously pivot in opposite directions upon shifting of the weight of the rider to thereby cause the wheels to traverse a curved path. Such roller skates or skateboards employing two pairs of wheels have certain functional limitations due to the requirement that each pair of wheels have some structure for supporting the axle therebetween. Furthermore, roller skates of such construction are generally unable to approximate the smooth stroke of an ice skate wherein the blade of the skate effectively defines a line of contact with the surface on which the skate is used, the center of gravity of the foot of the rider normally being applied downwardly through the plane of the blade.

Attempts have been made, in roller skates, to utilize two wheels on each roller skate, with one wheel toward the toe and the other wheel toward the heel of the soleplate, such two wheel roller skates being shown and described, for example, in U.S. Pat. No. 1,558,404 and 3,999,772. The construction of each of these patents has the axle of each wheel in fixed relation in parallel with the other. No steering means are provided.

Two wheel roller skates of the steerable variety are shown and described in U.S. Pat. No. 181,868; 2,204,280; and 2,719,724. In the last of the three abovementioned patents a connecting shaft with bevel gears on either end interconnects with a bevel gear on each of the wheel supporting members which rotate about a vertical axis with spring means interconnecting the roller or wheel supporting members. In such a construction, the soleplate is either spaced high relative to a supporting surface or the diameter of the wheels must be made correspondingly small to move the soleplate, and consequently the center of gravity of the rider, closer to the surface. In U.S. Pat. No. 181,868 an elaborate set of arms and linkages is employed in a two wheel roller skate construction using glass wheels.

In U.S. Pat. No. 2,204,280, a two wheel roller skate construction is shown in which the wheels are supported within axle forks which are resiliently limited to enable the rollers or wheels to deflect into an oblique position for travelling in a curve.

A skateboard utilizing two wheels is shown and described in U.S. Pat. No. 3,995,873.

In steerable two wheel rider supporting devices, there are two axes of interest relative to each truck or roller assembly, these axes being the wheel supporting axle or axis and the "steering" axis. The wheel supporting axis is normally the axle of the wheel which defines the center of rotation thereof and so long as the wheel is in ground engaging contact, this axis is normally parallel to the ground unless the wheel itself is contoured to enable the wheel to pivot relative to the ground. The "steering" axis, on the other hand, is defined as the axis about which the rotatably supported wheel pivots to enable the wheel axle to pivot relative to the longitudinal center line of the rider supporting member, be it a soleplate in the case of a roller skate or a board of a skateboard. The wheel supporting axis or axle in a two wheel rider supporting device structure extends on a line normally perpendicular to the longitudinal center line of the rider supporting member, the plane of the rider supporting member being normally parallel to the plane through which the wheel axis extends. In a steerable structure, as the weight of the rider shifts the plane of the rider supporting member is angularly disposed relative to the plane of the wheel axles and the individual axles rotate or pivot simultaneously in opposite directions relative to the longitudinal center line of the rider supporting member. This effects "steering" of the rider supporting device and in the abovementioned U.S. Pat. No. 2,719,724, for example, the steering axis would be a vertical axis of rotation of the wheel or roller supporting member.

In the roller skate and skateboard structures of prior art devices, the steering axis generally lies above the plane of the wheel axles, the steering axis in such prior art devices generally being vertically disposed relative to the rider supporting member or at an angle to the vertical. In such devices, the center of gravity of the total system, that is, the rider supporting device with the rider, is high relative to the supporting surface such as the ground or the like. Furthermore, in many of the prior art devices, the wheel tread width is too narrow resulting in the center of weight of the rider during pivoting of the rider supporting member exerting a force outside the width of the tread. That is, if an imaginary line were drawn perpendicular to the rider supporting member and through the longitudinal center line thereof, ideally to maintain traction, this line should intersect the ground within the width of the tread of the wheel and preferably as close to the center as possible. When this line extends outside the width of the tread of the wheel due to the plane of the rider supporting member being pivoted angularly relative to the ground or supporting surface, an unstable system results with more force being exerted laterally than downwardly.

Accordingly, it is an object of this invention to provide a new and improved rider supporting device such as a roller skate, skateboard or the like.

It is another object of this invention to provide a new and improved two wheel rider supporting device.

It is a further object of this invention to provide a new and improved truck for a rider supporting device wherein the steering axis lies below the plane of the wheel axle.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 1 is a perspective view of a two wheel roller skate according to the present invention;

FIG. 2 is a side view of the roller skate of FIG. 1, partially broken away and partially in cross section;

FIG. 3 is a bottom plan view of the roller skate of FIG. 1;

DESCRIPTION OF THE PREFERRED EMBODIMENT

Figure 4:
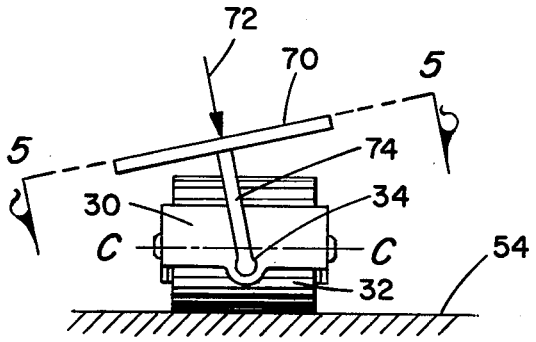
FIG. 4 is a front end view of a wheel supporting assembly showing diagramatically the relation to the plane of the rider supporting member during steering.

Referring now to the drawings and particularly to FIG. 1, there is shown a two wheel roller skate generally designated 10 according to the invention, the skate including a boot portion 12 having affixed to the bottom thereof a soleplate structure generally designated 14 which may be a one-piece molded structure suitably secured to the boot 12 for supporting the foot of a rider. The soleplate structure 14 is in downwardly depending relation to the soleplate of the boot 12 with integrally formed front wheel opening 16 and rear wheel opening 18 configured to support wheel assemblies generally designated 20 and 22, respectively.

Referring also to FIGS. 2 and 3, with reference particularly to front wheel assembly 20, the wheel opening 16 thereof is provided with downwardly depending arm portions 24 and 26 having generally parallel facing planar surfaces 25 and 27, respectively, within the wheel opening 16. Rotatably supported at the lowermost portion of the arms 25 and 26 is a cradle member 30 having a generally rectangular opening for rotatably supporting within the opening of the cradle member a wheel member 32.

For reference purposes, certain broken lines appear on the drawings of FIGS. 2 and 3. In FIG. 2, a line designated A—A extends generally horizontally, this line A—A representing the plane of the rider supporting member or soleplate of the soleplate structure 14, this plane being generally parallel to the wheel engaging surface. A broken line B—B extends through the centers of a front pivot member 34 and rear pivot member 36 of the trunnion or cradle member 30 of the wheel assembly 20, this line B—B being the "steering" axis of the front wheel assembly 20.

In FIG. 3, a broken line C—C extends through the axle 38 about which the wheel 32 is rotatably supported within the cradle member 30, this line C—C being the wheel axis. A fourth broken line D—D extends longitudinally with respect to the soleplate structure 14, this line being the longitudinal center line of the rider supporting member or soleplate of the soleplate structure 14. The longitudinal center line D—D will ordinarily exist in the same plane as the line A—A which is the plane of the soleplate of the soleplate structure 14, and the action and re-action in the operation of the two wheel roller skate structure will be described with reference to this plane and the longitudinal center line, the longitudinal center line normally being a line through which downwardly directed weights or forces are directed in a dynamic analysis of the operation of a roller skate or skateboard structure.

Referring again to FIGS. 1-3, the rear wheel assembly 22 has a substantially identical cradle member 40 pivotally supported at the lower ends thereof by pivot members 42 and 44 adjacent the lower edges of arms 46 and 48, respectively, of wheel opening 18, the cradle member 40 having rotatably supported therein a wheel member 50 coupled by means of an axle member 52 having its free ends suitably secured outside cradle member 40. The wheels 32 and 50 are adapted for rolling engagement with the surface 54 with the plane of the soleplate along line A-A being normally parallel to the surface 54.

Each of the cradle members 30 and 40 is biased to a neutral position by means of spring members 56 and 58, respectively, coupled to tongue portions 60 and 62, respectively, of cradle members 30 and 40, respectively, these tongue portions being centrally disposed and upwardly directed along the width of one side of the cradle members 30 and 40, respectively, disposed in general vertical alignment with the adjacent pivot member thereof. The springs 56 and 58 are suitably secured within openings 64 and 66, respectively, formed in soleplate structure 14. The purpose of springs 64 and 66 is to maintain the cradle members in a neutral position when the wheel members are lifted out of engagement with the wheel engaging surface 54, this neutral position being with the wheel axle line C—C generally parallel to the plane A—A of the soleplate member. Although spring members are illustrated, it is to be understood that other resilient, elastic or spring means coacting between the cradle members and the soleplate structure 14 may also be employed to provide the bias for maintaining the cradle members in the neutral position.

The roller skate assembly in FIGS. 2 and 3 is depicted in the "neutral" position, that is, with the weight of the rider unshifted, with the plane through line A—A generally parallel to the supporting surface 54 with wheel axles 38 and 52 parallel to both the supporting surface 54 and the plane A—A. The steering axis B—B of front wheel assembly 20 is disposed at an angle of approximately 7° to the plane of the supporting surface 54 with the steering axis B'—B' of the rear wheel assembly 22 being likewise inclined at an angle of 7°, the two steering axes being oppositely disposed, extensions of each of these axes inwardly toward each other resulting in a downwardly converging intersection. As can be seen in FIG. 3, the steering axis B—B is in normal alignment with the longitudinal center line D—D in bottom plan view. As the weight of the rider shifts, by reference to FIG. 3, the longitudinal center line D—D will move above or below the line of steering axis B—B. Referring again to FIG. 2, it can be seen that the axle 38 of front wheel 32 lies above the steering axis of cradle member 30 defined by line B—B, and visualizing a wheel axle plane extending through axle 38 in a direction parallel to the steering axis B—B, the wheel axle plane lies above the steering axis B—B at all times.

Prior to discussing the operation and dynamics of the two wheel roller skate 10, certain dimensions will be given by way of example and not of limitation. With reference to the front wheel assembly 20, it being understood that the rear wheel assembly 22 is substantially identical with the steering axis B'—B' thereof oppositely, angularly disposed, the dimensions of the front wheel assembly 20 will now be discussed. The wheel 32 may be, for example, 2¼ inches in diameter with a wheel tread of approximately the same dimension, with the opening within cradle member 30 being approximately square and slightly larger than the periphery of the wheel 32. The plane of the soleplate member defined by line A—A is approximately 2 inches above the center of the front pivot member 34 of the steering axis with the distance between the plane of the soleplate member and the center of rear pivot member 36 of the steering axis being approximately ⅜ of an inch longer. The wheel axle plane, is slightly less than ¼ inch above the steering axis line B—B, the foregoing dimensions being empirically selected to provide a two wheel roller skate 10 with rider stability and steering characteristics approximating the smoothness of an ice skater stroke.

Figure 5:
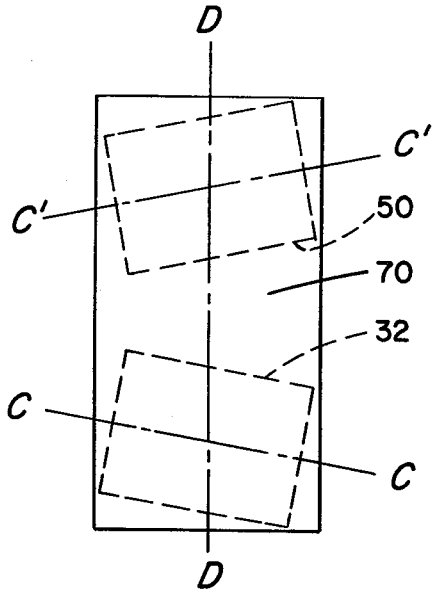
FIG. 5 is a diagramatic plan view illustrating the steering action relative to the rider supporting member as viewed generally along line 5—5 of FIG. 4.

Functionally, referring to FIG. 2, drawing first and second lines downwardly perpendicular to line A—A to the pivot points of front pivot member 34 and rear pivot member 36 of cradle member 30, it can be seen that two lever arms exist relative to the pivot members 34 and 36, the front lever arm, that is, the distance between the center of pivot member 34 and line A—A being shorter than the rear lever arm, that is, the distance between line A—A and the center of rear pivot member 36. The effect of the difference in lever arms is diagramatically illustrated in FIGS. 4 and 5 and the steering of the two wheel roller skate 10 will now be discussed. In FIGS. 4 and 5 a generally rectangular plate member 70 is diagramatically illustrated, this plate member 70 representing the soleplate defined by the plane of line A—A, the plate 70 being shown in the illustration in FIG. 4 relative to the front wheel 32 engaging the supporting surface 54. In FIG. 4, the plate 70 is depicted at an angle to the plane of the supporting surface 54 with an arrow 72 on plate member 70 generally perpendicular to and intermediate opposite edges thereof to indicate the center of weight of the foot of the rider relative to the plate 70. This angular orientation of the soleplate or plate 70 will occur when the rider shifts his weight to effect a turning or steering maneuver. Due to the constraint imposed by the engagement of the tread of wheel 32 with the surface 54, the wheel axle defined by line C—C will remain at all times during this engagement parallel to the surface 54. A solid double line in the shape of a bar member 74 extends perpendicular to the undersurface of plate 70 to interconnect with the front pivot member 34, this bar member 74 diagramatically depicting the front lever arm of cradle member 30 previously discussed. This lever arm or bar 74 is a fixed distance with relative rotation between the plate member 70 and the lower ground engaging tread of wheel 32 being effected about the steering axis extending through the center of front pivot member 34. Although not illustrated, it is to be understood that a second lever arm lies behind the lever arm or bar 74, this rear lever arm being slightly longer, that is, approximately ⅜ inch longer. Viewing this action downwardly from the plane of the plate member 70, as shown in FIG. 5, the rear pivot arm of front wheel 32 provides relative rotation of the rear pivot member 36 a slightly greater distance clockwise than the front lever arm 74 with respect to the front pivot member 34. This is depicted in FIG. 5 in exaggerated form wherein the rear wheel 50 having its longer lever arm forward of wheel 50 provides rotation relative to the plane of plate member 70 in a counterclockwise direction. In plan view, as depicted in FIG. 5, the front wheel axle C—C and the rear wheel axle C′—C′ are angularly rotated toward each other to define a curve for steering the roller skate 10. This rotation in the plane of plate member 70, as shown in FIG. 5, is about the longitudinal center line D—D of the soleplate or plate member 70.

Figure 6:
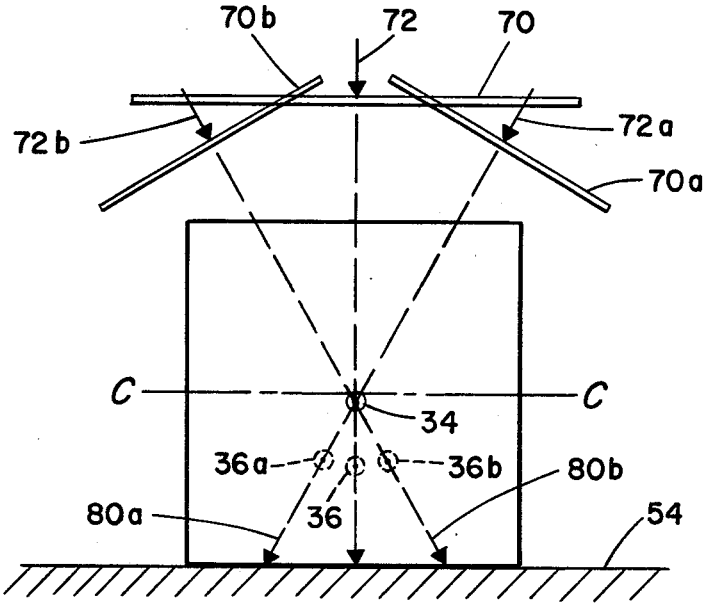
FIG. 6 is a diagramatic illustration similar to FIG. 4 depicting the center of weight of a rider relative to the front pivot of the steering axis.

The dynamic characteristics of the two wheel roller skate assembly is diagramatically illustrated in FIG. 6 wherein the front wheel member 32 is shown in ground engaging contact with the surface 54 with the plate member 70 being depicted in three different positions, these being in a plane parallel to the surface 54 as depicted by plate 70 with the arrow 72 being the direction of center of weight of the rider; at an angle of 30° clockwise relative to the supporting surface 54 as depicted by plate member **70*a* and center of weight arrow 72*a*; and a position 30° counterclockwise relative to the surface 54 as depicted by plate member 70*b* with the center of weight arrow 72*b*. The angular positions referred to are with respect to the center of the front pivot member 34 about which the plate member 70 is relatively rotated. Shown in dotted lines immediately beneath the circle depicting the front pivot member 34 is the rear pivot member 36 which is also shown in dotted lines in alternate positions 36*a* and 36*b*, these positions of the rear pivot member 36** corresponding to the angular orientation of the plate member with the like designated suffix.

As can be seen in FIG. 6, the front pivot member 34 is disposed slightly below the wheel axle plane extending through the wheel axle C—C with the rear pivot member 36 being disposed below the center of the front pivot member 34. The dashed lines in alignment with each of the arrows 72, etc., depicts the line of force through the center of front pivot member 34 with the lowermost arrows at the ends of the dashed lines contacting the surface 54 to show the effective line of force relative to the supporting surface 54 with respect to the outer periphery of front wheel member 32.

With the plate member 70 in its neutral position, that is, with the weight or center of weight represented by arrow 72 being unshifted, the force is directed perpendicular to plate 70 and downwardly through the center of front pivot member 34 to a point perpendicular to the supporting surface 54. As the rider shifts the weight until the plane of member 70 is in the position designated **70*a*, the center of weight presented by arrow 72*a* is still perpendicular to the plane of plate member 70*a* and extends through the center of front pivot member 34 to a point designated 80*a* on surface 54, the point 80*a* being well within the tread of wheel member 32. Correspondingly, if the weight of the rider is shifted in the opposite direction with the plate members being in the position designated 70*b*, the center of weight represented by arrow 72*b* passing through the center of pivot member 34 is directed to a point 80*b* which is likewise well within the tread width of the wheel 32. As depicted by the dotted circles 36*a* and 36*b*, the rear pivot member 36, during the steering maneuver, rotates relative to the center of front pivot member 34 with the position of the rear pivot member 36 being correspondingly closer to the supporting surface 54, with both pivot members being below the wheel axle defined by line C—C. This configuration provides stability to the two wheel roller skate system. With the steering axis below the axis of rotation of the wheel, the force lines extending through the center of weight arrows for a given amount of angular rotation of the plate member 70 relative to the steering axis line keeps the point of intersection of the force line relative to the supporting surface 54 within a very narrow lateral dimension. If one were to visualize the steering axis extending between the center of front pivot 34 and rear pivot 36 being raised relative to the supporting surface 54 with the distance between the center of pivot 34 and plate member 70 remaining the same, the lateral distance between points 80*a* and 80*b* would increase to render the system unstable. With the steering axis below the plane of the wheel axis, that is, with the steering axis closer to the ground supporting surface 54 than the wheel axis, the force is directed against supporting surface 54 a short distance on either side of a normal vertical force line extending through center of weight arrow 72** to thereby provide a more stable dynamic roller skate structure.

While there has been shown and described a preferred embodiment, it is to be understood that various other adaptations and modifications may be made within the spirit and scope of the invention.

What is claimed is:

1. In a rider supporting device, such as a roller skate, skateboard or the like, the combination comprising:

a rider supporting member having a longitudinal center line extending generally in the direction of travel thereof;

at least one cradle member;

a wheel rotatably mounted to said cradle member for rotation about an axis with said wheel being adapted for engaging a surface; and means for mounting said cradle member to said rider supporting member for pivoting about an axis extending generally in the direction of said longitudinal center line, said cradle pivoting axis being angularly disposed relative to said surface and generally intermediate said wheel axis and said surface with said wheel axis extending in a direction generally perpendicular to said cradle pivoting axis, said cradle pivoting axis defining a steering axis for providing rotation of said wheel axis relative to said longitudinal center line whereby to steer said device.

2. The combination according to claim 1 further including means operatively coupled to said cradle members for biasing said cradle member to a position with said wheel axis generally parallel to said rider supporting member.

3. The combination according to claim 2 wherein said cradle member has a generally rectangular opening and said wheel member is mounted within said opening.

4. The combination according to claim 3 wherein said cradle pivoting axis is normally angularly disposed at an angle of approximately seven degrees to said surface.

5. The combination according to claim 4 wherein the biasing means is a spring member coupled to said cradle member and to said rider supporting member.

6. In a two wheel roller skate, the combination comprising:

a soleplate member having a longitudinal center line extending generally in the intended direction of travel thereof;

a structure downwardly depending from said soleplate member and having first and second wheel openings in spaced relation, said wheel openings extending generally transverse to the direction of said center line;

first and second substantially identical cradle members pivotally mounted to said structure within said first and second wheel openings, the pivoting axis of each of said cradle members extending generally in the direction of said longitudinal center line and being disposed angularly relative to said longitudinal center line, and when viewed in side elevation said pivoting axes being inwardly and downwardly converging relative to each other; and first and second wheel members being adapted for engaging a surface and being rotatably mounted to said first and second cradle members, respectively, for rotation about axes normally parallel to each other, said wheel axes being intermediate said pivoting axes and said soleplate member, the shifting of the weight of the rider on said soleplate member effecting simultaneous opposite rotation of said wheel axes relative to said longitudinal center line whereby to steer said device.

7. The combination according to claim 6 wherein said skate further includes means interconnecting said cradle members and said structure for biasing said cradle member to a neutral position with said wheel axes normally parallel to each other.

8. The combination according to claim 7 wherein each of said cradle members has a generally rectangular opening with a wheel member therein.

9. The combination according to claim 8 wherein each of said pivoting axes normally lies in a plane extending through said longitudinal center line.

10. The combination according to claim 9 wherein said downwardly depending structure is integral with said soleplate member.

11. The combination according to claim 10 wherein each of said pivoting axes is at an angle of approximately seven degrees of said surface.

* * * * *